US007097503B2

(12) United States Patent
Tsuji

(10) Patent No.: US 7,097,503 B2
(45) Date of Patent: Aug. 29, 2006

(54) CONNECTOR AND A METHOD OF DISASSEMBLING IT

(75) Inventor: Takeshi Tsuji, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/122,557

(22) Filed: May 4, 2005

(65) Prior Publication Data

US 2005/0250385 A1 Nov. 10, 2005

(30) Foreign Application Priority Data

May 7, 2004 (JP) ..... 2004-138836

(51) Int. Cl.
*H01R 13/40* (2006.01)

(52) U.S. Cl. ..... 439/595; 439/752

(58) Field of Classification Search ..... 439/595, 439/752

See application file for complete search history.

(56) References Cited

U.S. PATENT DOCUMENTS 5,730,626 A 3/1998 Tomita et al. ..... 439/595
6,077,117 A * 6/2000 Iwahori ..... 439/595
6,786,768 B1 * 9/2004 Murakami ..... 439/595
6,939,170 B1 * 9/2005 Torii ..... 439/595
2005/0048837 A1 * 3/2005 Ichida et al. ..... 439/595

FOREIGN PATENT DOCUMENTS

JP 11-250970 9/1999

* cited by examiner

*Primary Examiner*—Hae Moon Hyeon
(74) *Attorney, Agent, or Firm*—Gerald E. Hespos; Anthony J. Casella

(57) ABSTRACT

A housing (20) includes a terminal accommodating portion (21) for accommodating terminal fittings (10), and an outer tube (22) surrounding the terminal-accommodating portion (21) and having an open front end. A mounting member (40) is detachably mountable on the terminal-accommodating portion (21) along forward and backward directions through an opening of the outer tube (22). The mounting member (40) has first and second jig catches (54, 55) that can be caught by a jig (J) inserted into the outer tube (22). The jig (J) can be levered to move the mounting member (40) forward. The first and second jig catching portions (54, 55) are arranged at positions displaced along forward and backward directions.

9 Claims, 16 Drawing Sheets

CONNECTOR AND A METHOD OF DISASSEMBLING IT

BACKGROUND OF THE INVENTION

1. Field of the Invention

The present invention relates to a connector.

2. Description of the Related Art

Japanese Unexamined Patent Publication No. H11-250970 discloses a connector with a housing that has a terminal-accommodating portion for accommodating terminal fittings. Resiliently deformable locks are formed in the terminal-accommodating portion for locking the terminal fittings in the housing. An outer tube surrounds the terminal-accommodating portion and has an open front end, and a front retainer is detachably mountable on the terminal-accommodating portion through the opening in the outer tube. The front retainer includes deformation-preventing portions that engage the locks and prevent resilient deformation of the locks when the front retainer is mounted properly to the terminal accommodating portion.

FIG. 17 shows a front retainer 1 that can be used with a jig 2 to detach the front retainer 1 from a housing. The outer surface of the front retainer 1 has a jig catching projection 3, as shown in FIG. 17. The jig 2 is placed on a front end 4*a* of the outer tube 4 while the end of the jig 2 engages the jig catching portion 3. The jig 2 then is levered with the front end 4*a* as a fulcrum to move the front retainer 1 forward. However, the jig 2 is displaced from a forward-inclined posture shown in solid line in FIG. 17 to a backward-inclined posture shown in phantom line. This is a difficult movement in many situations due to a lack of room for the necessary lever action.

The present invention was developed in view of the above problem and an object thereof is to improve the operability of a jig.

SUMMARY OF THE INVENTION

The invention relates to a connector with a housing that has a terminal-accommodating portion for accommodating terminal fittings. A mounting member is mountable on the terminal-accommodating portion substantially along forward and backward directions. The mounting member has jig catching portions arranged at positions displaced along forward and backward directions and catchable by a jig inserted into the housing. The jig can be levered to move the mounting member forward. The jig can be engaged with jig catching portions located farther towards the back every time the mounting member is moved forward by a specified distance. Thus, the operational efficiency of the jig is better.

The housing preferably has an outer tube that at least partly surrounds the terminal-accommodating portion. The outer tube has an open front end and the mounting member is mountable to the terminal accommodating portion substantially along forward and backward directions through an opening of the outer tube.

The jig preferably can be levered with a portion of the housing on or near the outer tube as a fulcrum.

The mounting member preferably is movable substantially along forward and backward directions between a first position and a second position.

Resiliently deformable locks preferably are formed in the terminal-accommodating portion for locking the terminal fittings in the housing. Deformation preventing portions preferably are formed on the mounting member. The deformation preventing portions are retracted forward from deformation spaces for the locks when the mounting member is in the first position. However, the deformation preventing portions preferably in the deformation spaces when the mounting member is in the second position for preventing deformation of the locks.

The mounting member preferably includes at least one first jig catching portion for moving the mounting member from the second position to the first position and at least one second jig catching portion for detaching the mounting member from the first position. The first and second jig catching portions preferably are arranged along forward and backward directions.

A distance between the first and second jig catching portions along the forward and backward direction preferably is substantially equal to a moving distance of the mounting member between the first and second positions.

The jig catching portions preferably are arranged at positions displaced along a direction substantially normal to forward and backward directions and are connected by a connecting portion. Thus, the jig can be slid efficiently along the connecting portion upon engaging the jig again, and the connecting portion acting as a guide.

The invention also relates a method for disassembling a connector. The method includes providing a connector with a housing that has a terminal-accommodating portion for accommodating one or more terminal fittings. A mounting member is assembled to the terminal-accommodating portion substantially along forward and backward directions. The method includes engaging a jig sequentially at each of a plurality of jig catches displaced along forward and backward directions on the mounting member and levering the jig after each sequential catch to disassemble the mounting member from the terminal-accommodating portion.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female connector according to the invention is illustrated in FIGS. 1 to 16. The female connector has female terminal fittings 10 accommodated in a housing 20. In the following description, inserting and withdrawing directions IWD of the terminal fittings 10 into and from the housing 20 are referred to as forward and backward directions FBD, respectively, and reference is made to FIGS. 1 and 8 concerning the vertical direction. A mating side of the housing 20 with an unillustrated mating housing is referred to as the front.

Figure 10:
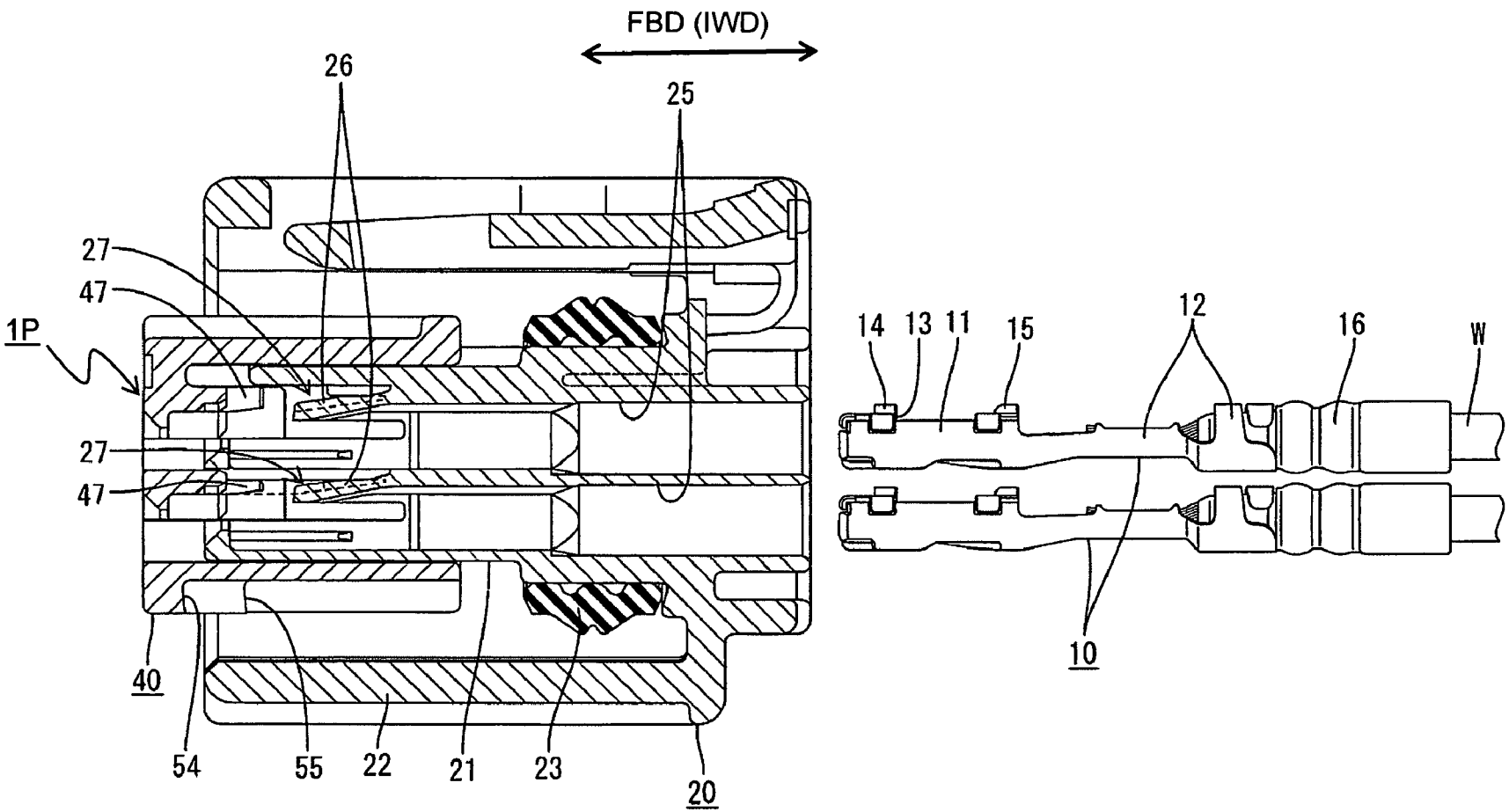
FIG. 10 is a section similar to FIG. 8, but showing the mounting member at a partial locking position.

Each terminal fitting 10 is formed by press-forming a conductive metal plate and, as shown in FIG. 10, has a main portion 11 and a barrel 12 coupled one after the other. The main portion 11 is substantially in the form of a box with open front and rear ends. The barrel 12 is configured for connection with an end of a wire W. A notch 13 is formed substantially in a longitudinal intermediate position of an upper wall of the main portion 11, and a locking projection 14 projects out and up at the front edge of the notch 13. A protrusion 15 is provided at the rear end of the outer wall and projects up and out to substantially the same height as the locking projection 14. The barrel 12 has two front crimping pieces and two rear crimping pieces. The front crimping pieces are to be crimped, bent or folded into connection with a core of the wire W and the rear crimping pieces are to be crimped, bent or folded into connection with a sealing plug 16 mounted on an insulation coating of the wire W.

The housing 20 is made e.g. of a synthetic resin and has a terminal accommodating portion 21 for accommodating the terminal fittings 10 and a forwardly open outer tube 22 surrounds the terminal accommodating portion 21. A housing of a mating male connector (not shown) is insertable between the terminal accommodating portion 21 and the outer tube 22. A seal ring 23 is mounted to the outer peripheral surface of the terminal accommodating portion 21 to closely contact the mating housing and to provide sealing between the two housings. The outer tube 22 is a wide rectangular tube coupled to the terminal-accommodating portion 21 at a position near the rear end of the terminal-accommodating portion 21. An upper part of the outer tube 22 is cut to form a lock arm 24 for holding the mating housing.

The terminal accommodating portion 21 is a wide block that extends over substantially the entire length of the housing 20. Cavities 25 are provided substantially side-by-side at upper and lower stages in the terminal-accommodating portion 21 and receive the terminal fittings 10 from behind. A lock 26 is provided on the ceiling of each cavity 25 and engages the terminal fitting 10 to retain the terminal fitting 10 in the cavity 25. Each lock 26 is cantilevered forwardly, and is resiliently deformable vertically along a direction intersecting the inserting and withdrawing directions IWD of the terminal fitting 10. The lock 26 enters a deformation space 27 above the lock 26 during the resilient deformation. The upper surface of each lock 26 slopes down and in towards the front. However, the lower surface of the lock 26 is substantially horizontal and parallel to the inserting and withdrawal directions IWD. Thus, the lock 26 tapers towards the front and is thicker towards the rear. The lock 26 is wider than the cavity 25 and has a substantially T-shape when viewed from the front. A widthwise-intermediate portion is thicker and the opposite widthwise ends are thinner. Further, an insertion groove 28 extends substantially continuously along the ceiling of the cavity 25 and the lower surface of the lock 26 (see FIG. 2). The insertion groove 28 has a front end at an intermediate position of the lock 26 and becomes shallower from the base end of the lock 26 towards the front end. Thus, the bottom surface of the insertion groove 28 is sloped to guide the locking projection 14 and to push the lock 26.

Figure 1:
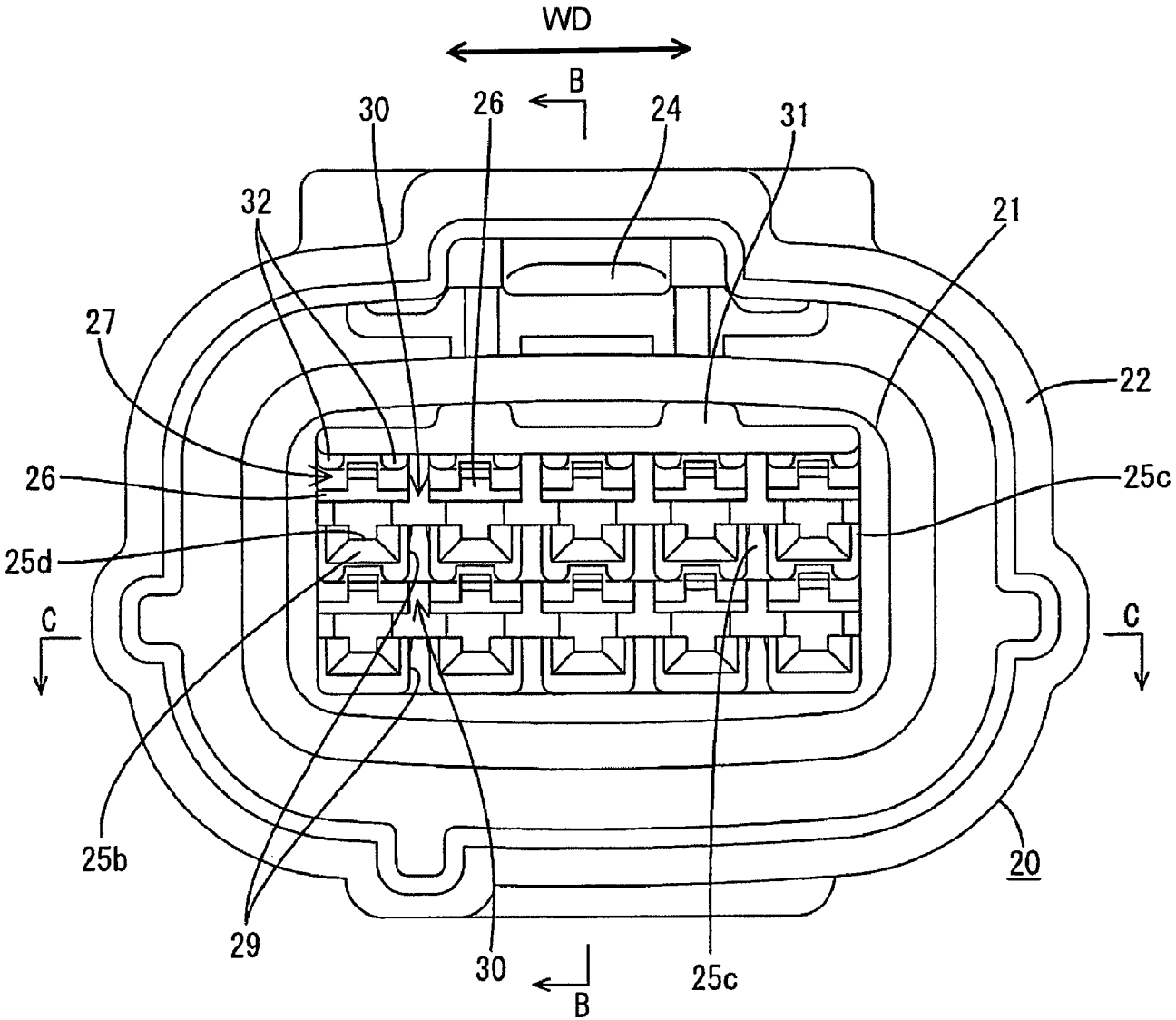
FIG. 1 is a front view of a housing according to one embodiment of the invention.
Figure 2:
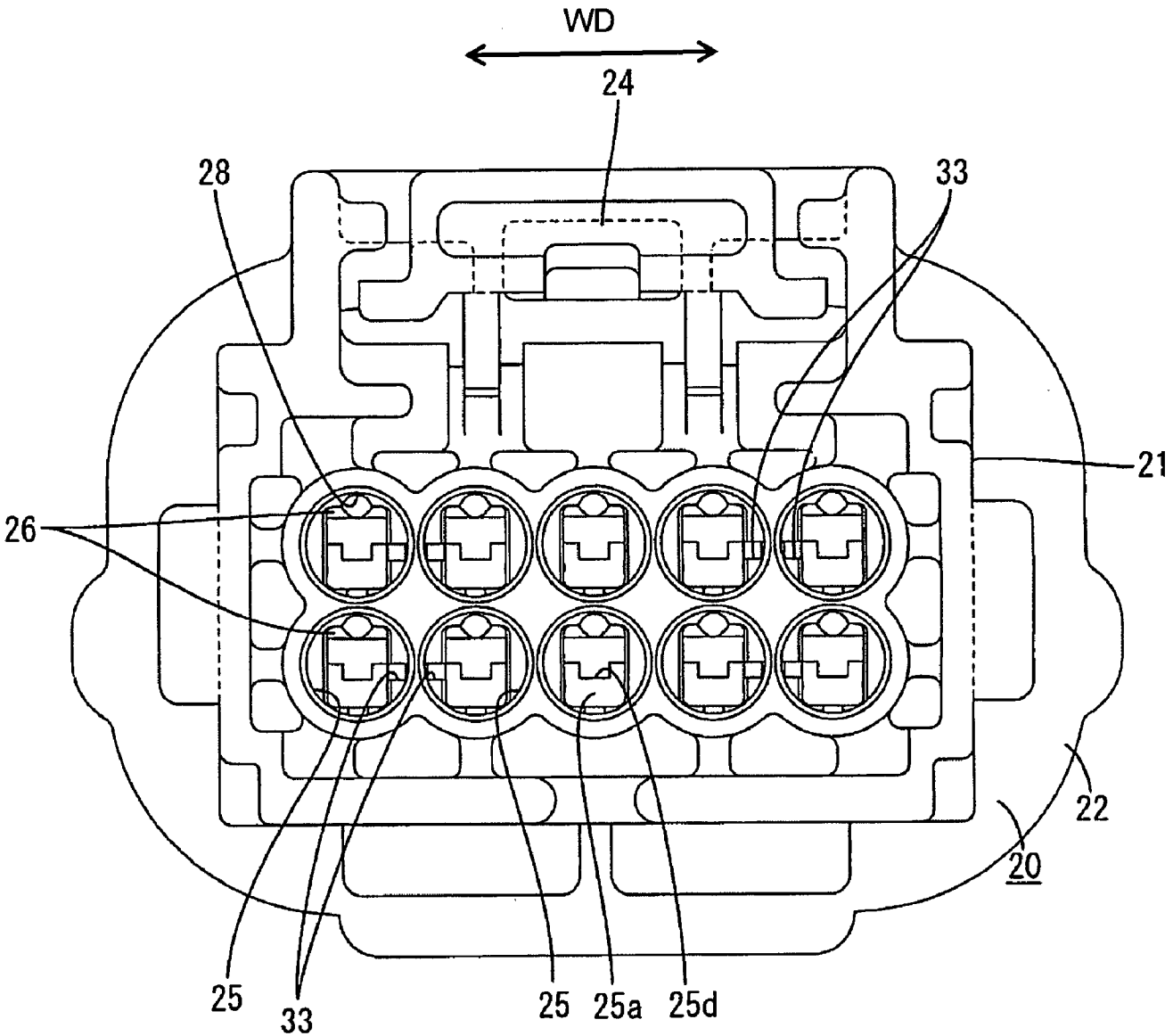
FIG. 2 is a rear view of the housing.
Figure 9:
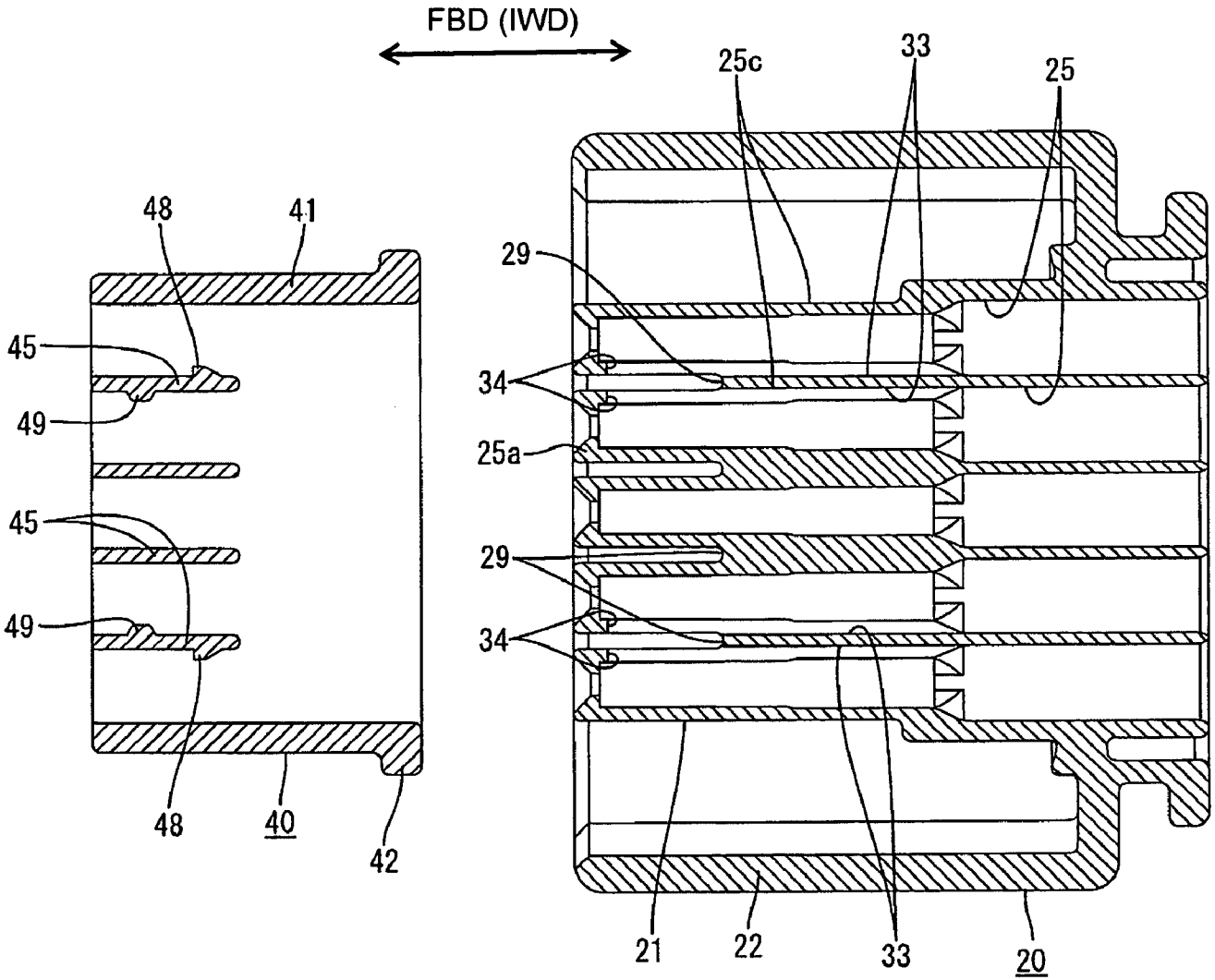
FIG. 9 is a section along 9—9 of FIGS. 1 and 3 showing the state before the mounting member is mounted into the housing.

An upper wall 25*a* of each cavity 25 is cut off entirely before the lock 26, and a front wall 25*b* and opposite sidewalls 25*c* of each cavity 25 have approximately their upper halves cut off before the lock 26 so that the lock 26 can be formed. As shown in FIGS. 1 and 9, a forwardly open groove 29 is formed substantially in the widthwise middle of a front part of the remaining lower half of each sidewall 25*c*. The back end of the groove 29 is forward of the base end of the lock 26, and penetrates the sidewall 25*c* vertically. The grooves 29 have widths substantially equal to the widths of groove-shaped spaces 30 between the locks 26 along width direction WD, and align with the groove-shaped spaces 30 with respect to the width direction WD. A guiding wall 31 is provided in the terminal-accommodating portion 21 above the upper stage locks 26 and two projections face each other. As shown in FIG. 1, two excessive deformation preventing portions 32 project down from the lower surface of the guiding wall 31 and from the lower surfaces of the front parts of the opposite side walls 25*c* of each upper stage cavity 25 to engage the respective locks 26 before the lock 26 deforms beyond its resiliency limit. These positions correspond to the opposite widthwise sides of each lock 26. Thus, excessive deformation of the lock 26 is prevented. Further, a tab insertion hole 25*d* is formed in the lower half of the front wall 25*b* of each cavity 25 to permit passage insertion of a tab of a mating male terminal fitting.

Figure 3:
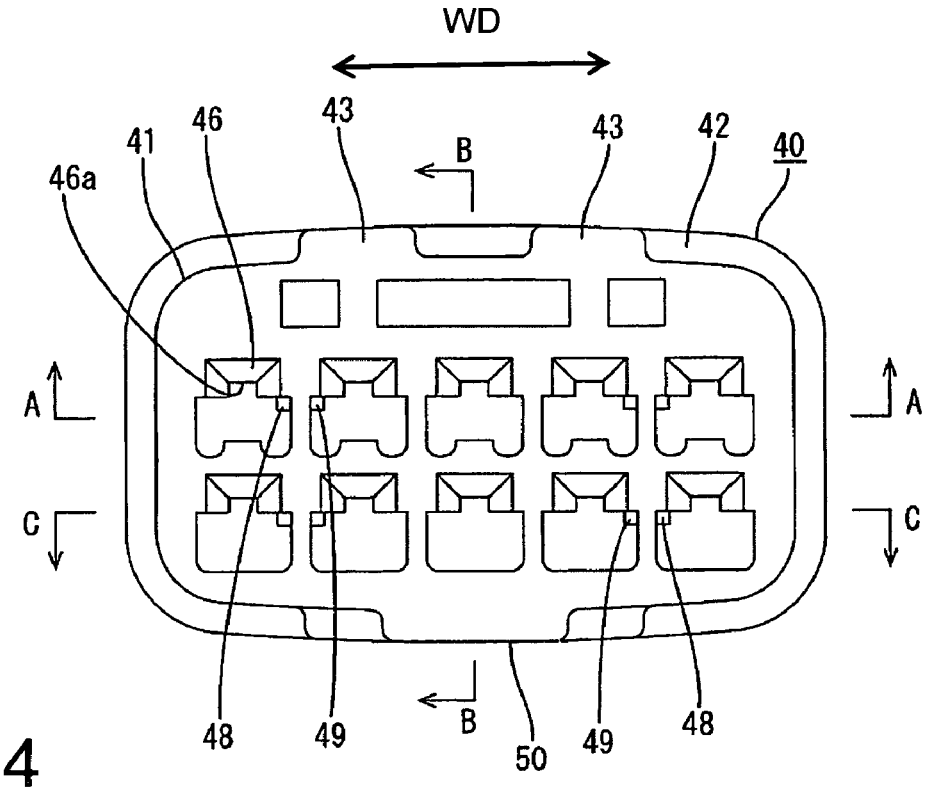
FIG. 3 is a front view of a mounting member.
Figure 8:
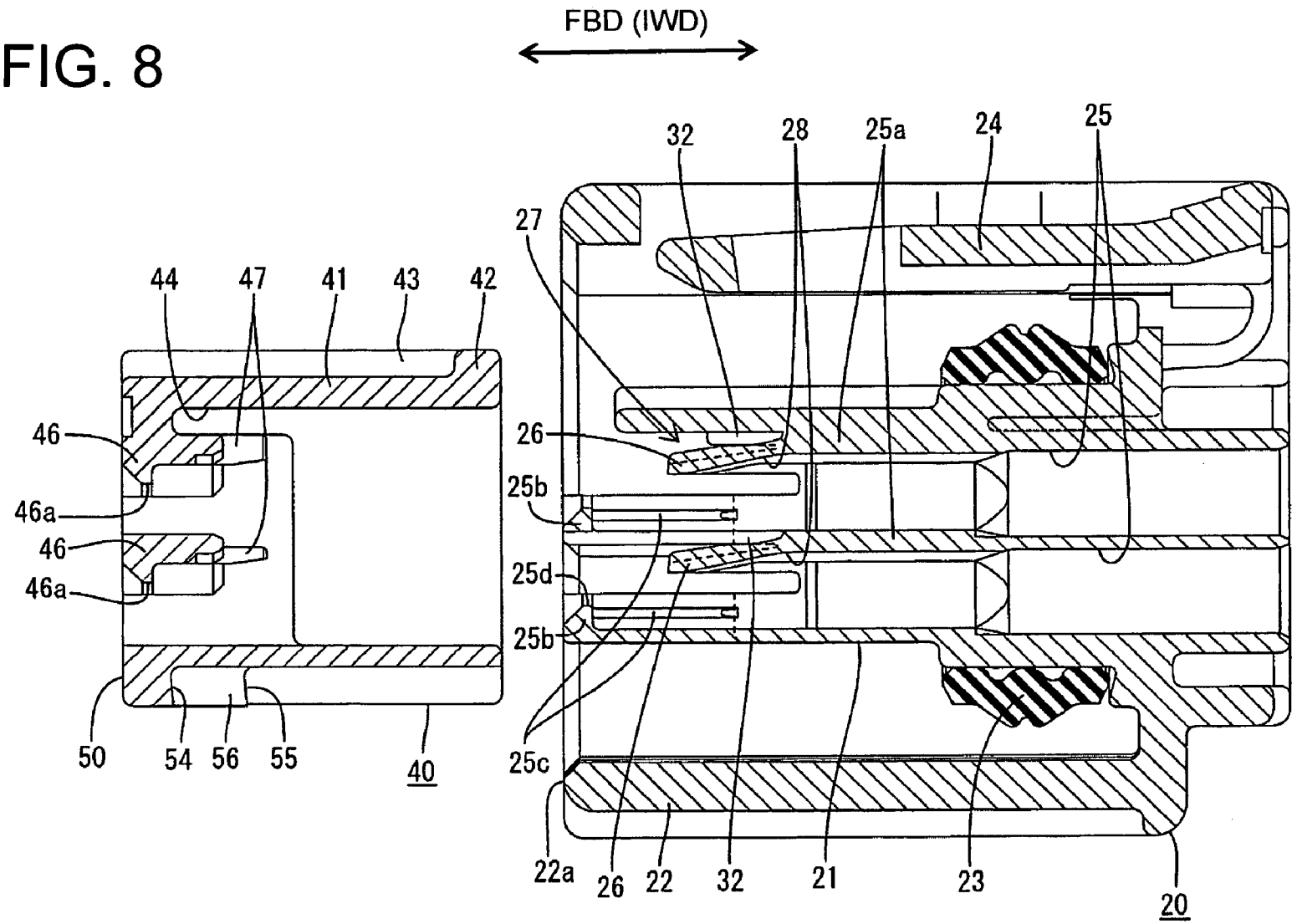
FIG. 8 is a section along 8—8 of FIGS. 1 and 3 showing a state before the mounting member is mounted into the housing.

A mounting member 40 made e.g. of a synthetic resin is fittable on the terminal accommodating portion 21, and includes a wide tubular main portion 41, as shown in FIGS. 3 and 8. A step 42 bulges out at the rear end of the outer peripheral surface of the main portion 41 over substantially the entire periphery. The step 42 engages the seal ring 23 to prevent the seal ring 23 from coming out (see FIG. 13). As shown in FIG. 5, two reinforcing ribs 43 extend along forward and backward directions FBD on the upper surface of the main portion 41 and are coupled to the step 42. A rearwardly open guiding groove 44 is formed in the rear surface of the upper part of the main portion 41, as shown in FIG. 4, for receiving the front end of the guiding wall 31.

Figure 4:
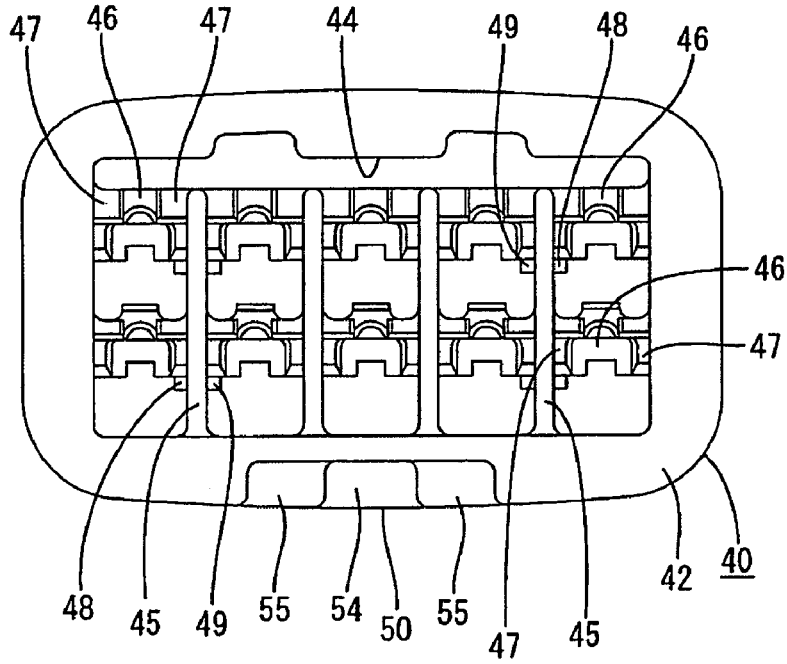
FIG. 4 is a rear view of the mounting member.
Figure 5:
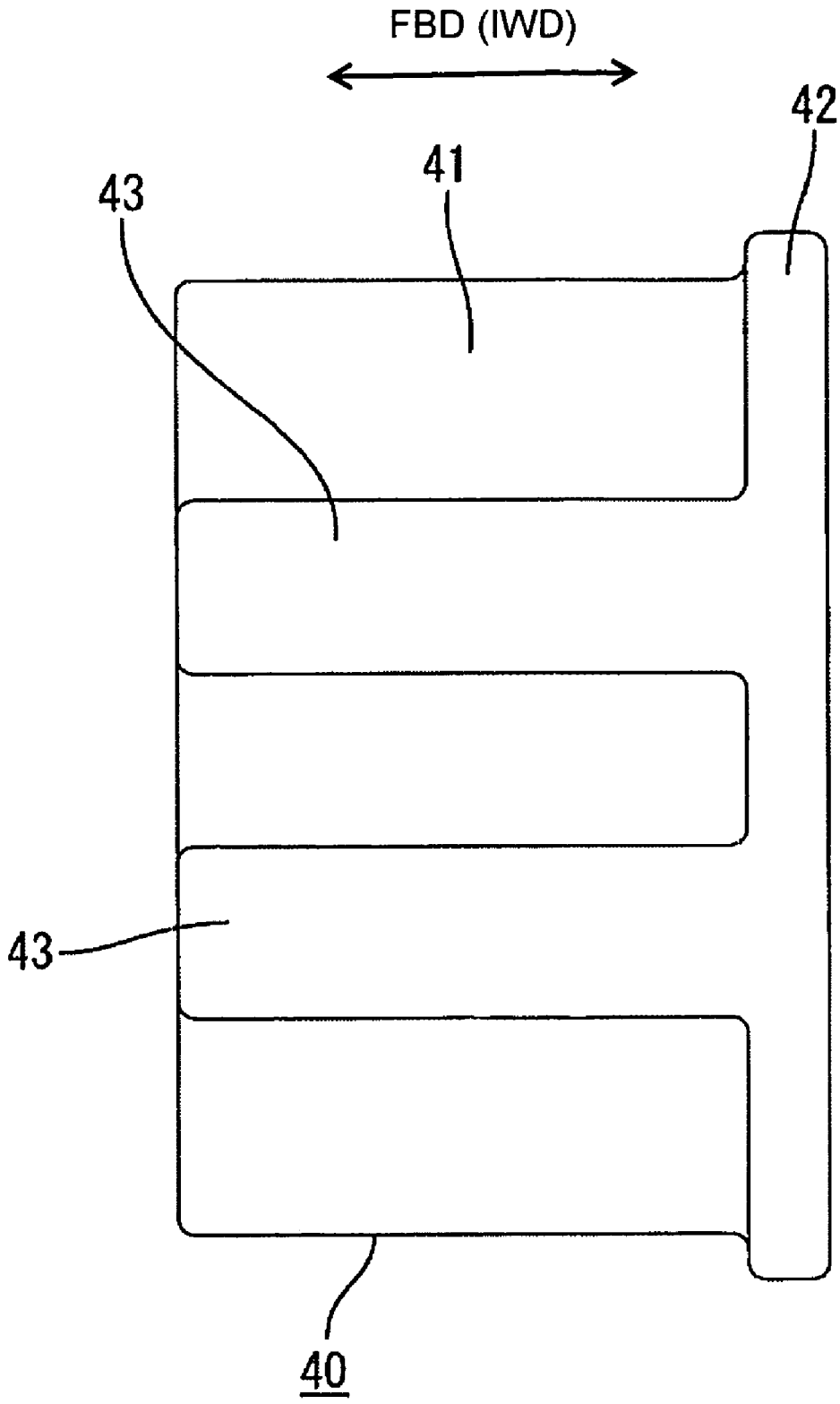
FIG. 5 is a plan view of the mounting member.

As shown in FIGS. 4 and 9, four vertical partition walls 45 traverse the main portion 41. The partition walls 45 enter the corresponding grooves 29 and the groove-shaped spaces 30 between adjacent locks 26 as the mounting member 40 is mounted to the housing 20. Thus, the partition walls 45 partition the adjacent locks 26 and insulate the terminal fittings 10 in the adjacent cavities 25 from each other (see FIG. 14).

Figure 6:
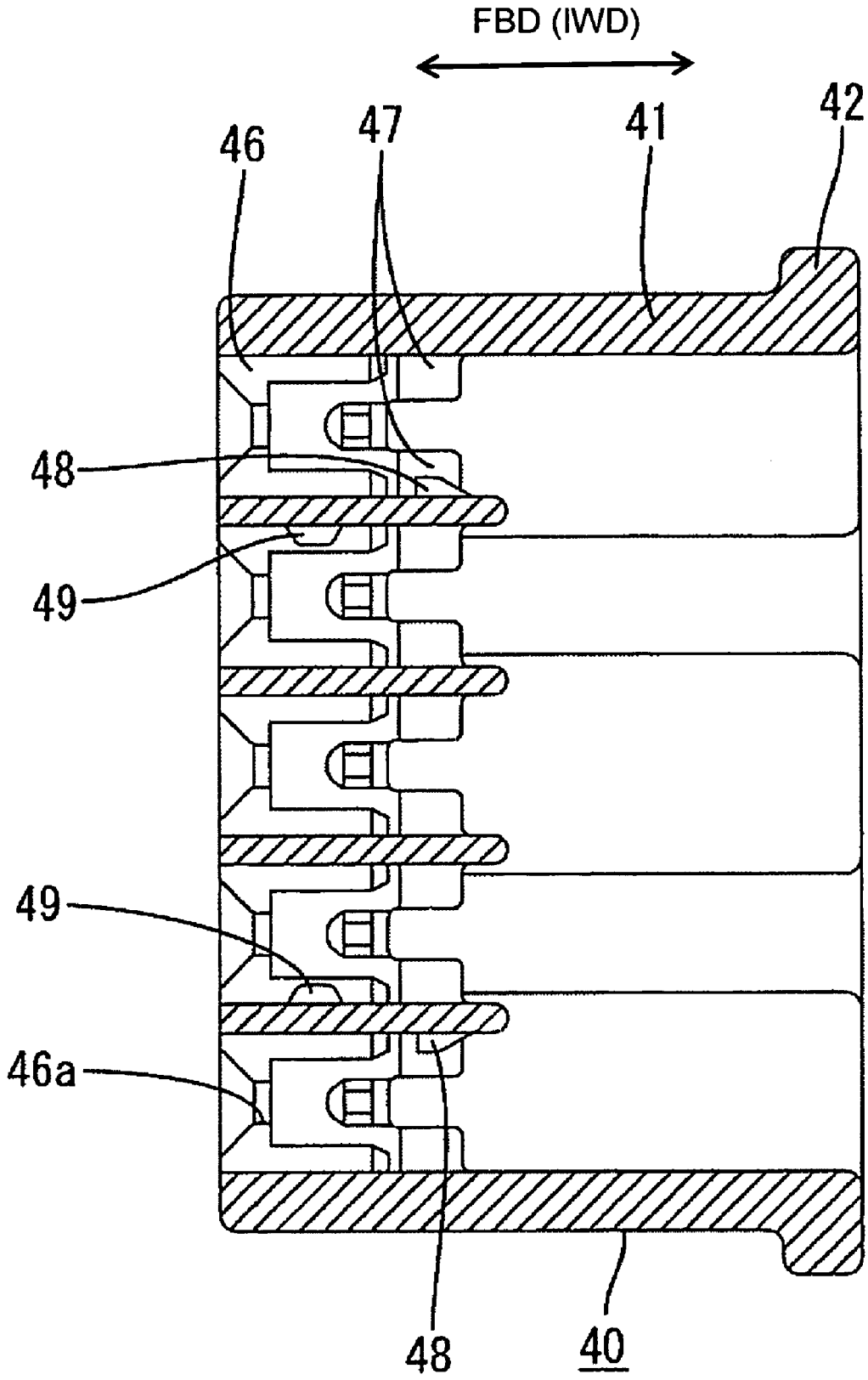
FIG. 6 is a section along 6—6 of FIG. 5.

Walls 46 are provided at a front side of the main portion 41 in positions corresponding to the respective cavities 25, as shown in FIGS. 3, 4, 8 and 13. Each wall 46 is before the corresponding lock 26 in the mounted state of the mounting member 40. The walls 46 fill in the cut parts of the walls surrounding the respective cavities 25 of the housing 20. Thus, each wall 46 is before the front end of the upper wall 25*a* of the cavity 25 and aligns with remaining parts of the front wall 25*b* and the opposite side walls 25*c* of the cavity 25 (see FIG. 13). The part of each wall 46 aligned with the front wall 25*b* of the corresponding cavity 25 forms part of a tab insertion hole 46*a* that aligns with the corresponding tab insertion hole 25*d* of the housing 20. Deformation preventing portions 47 are provided at the rear ends of the respective walls 46 and enter the deformation spaces 27 for the locks 26. More specifically, two deformation preventing portions 47 are provided at spaced-apart positions corresponding to the opposite widthwise ends of each lock 26, as shown in FIGS. 4 and 6, and enters the deformation spaces 27 at positions between the opposite widthwise ends of each lock 26 and the opposite excessive deformation preventing portions 32 (see FIG. 1). The partition walls 45 extend farther back than the deformation preventing portions 47.

The mounting member 40 is movable forward and back in the housing 20 between a partial locking position 1P and a full locking position 2P. The deformation preventing portions 47 are retracted forward from the deformation spaces 27 for the locks 26 when the mounting member 40 is in the partial locking position 1P to permit insertion of the terminal fittings 10 into the cavities 25 (see FIG. 10). The deformation preventing portions 47 enter the deformation spaces 27 to prevent deformation of the locks 26 when the mounting member 40 is in the full locking position 2P (see FIG. 13).

The partition walls 45 of the mounting member 40 at the opposite ends have two first holding projections 48 and two second holding projections 49, as shown in FIG. 3. The holding projections 48, 49 are on the two opposite surfaces of the partition wall 45 at positions adjacent the lower sides of the upper and lower walls 46. More specifically, the right partition wall has the first holding projections 48 on the right surface and the second holding projections 49 on the left surface, as shown in FIG. 3. The left partition wall has the first holding projections 48 on the left surface and the second holding projections 49 on the right surface, as shown in FIG. 3. The first holding projections 48 are behind the second holding projections 49, as shown in FIG. 9. The holding projections 48, 49 are insertable into the rearwardly open locking grooves 33 in the sidewalls 25*c* of the cavities 25. The locking grooves 33 are formed by recessing the opposite widthwise ends of the sidewall 25*c*, and the height of each locking groove 33 substantially equals the height of the holding projections 48, 49. Locking sections 34 are formed at the front edges of the locking grooves 33 and engage the holding projections 48, 49.

Figure 11:
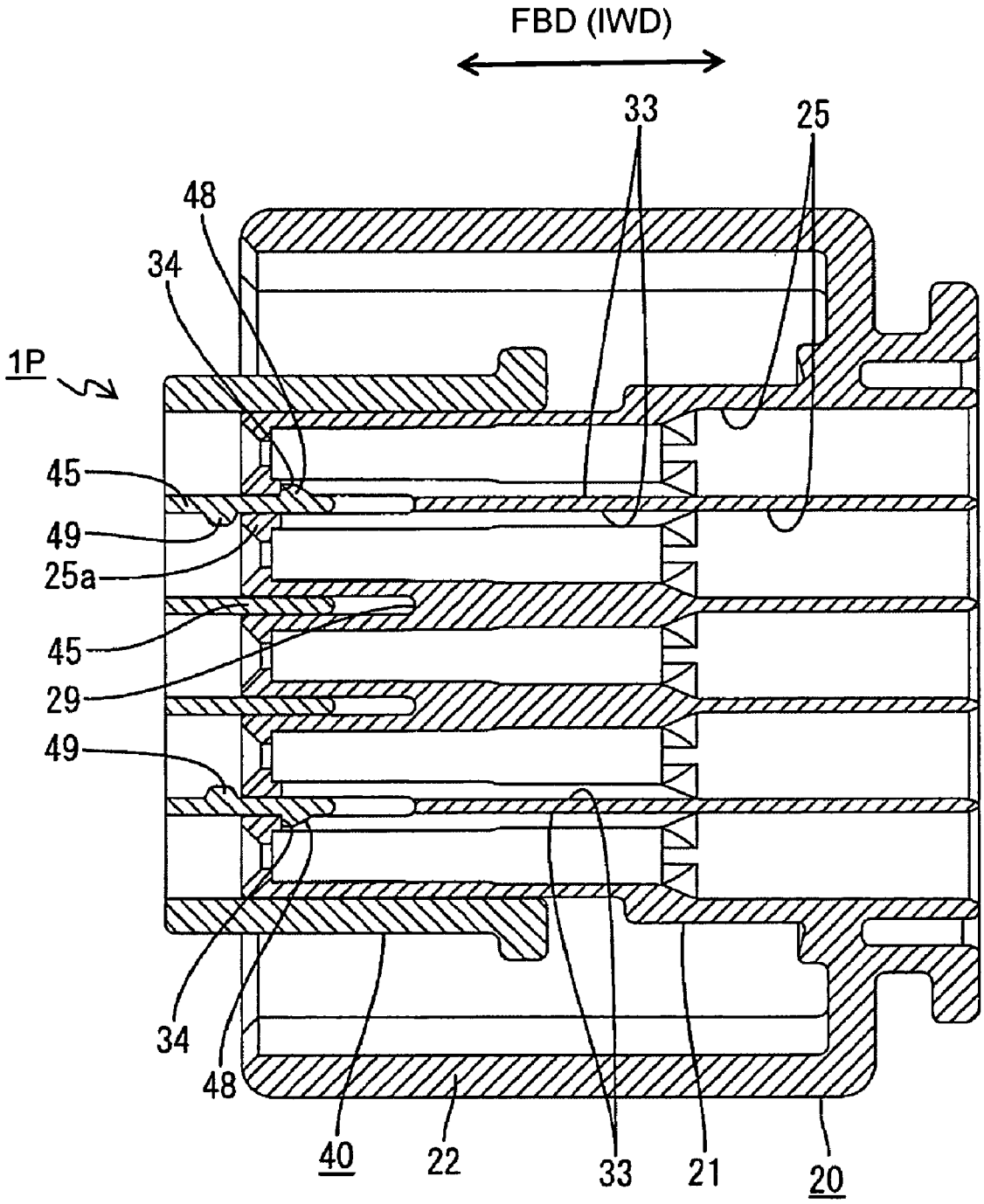
FIG. 11 is a section similar to FIG. 9, but showing the mounting member at the partial locking position.
Figure 13:
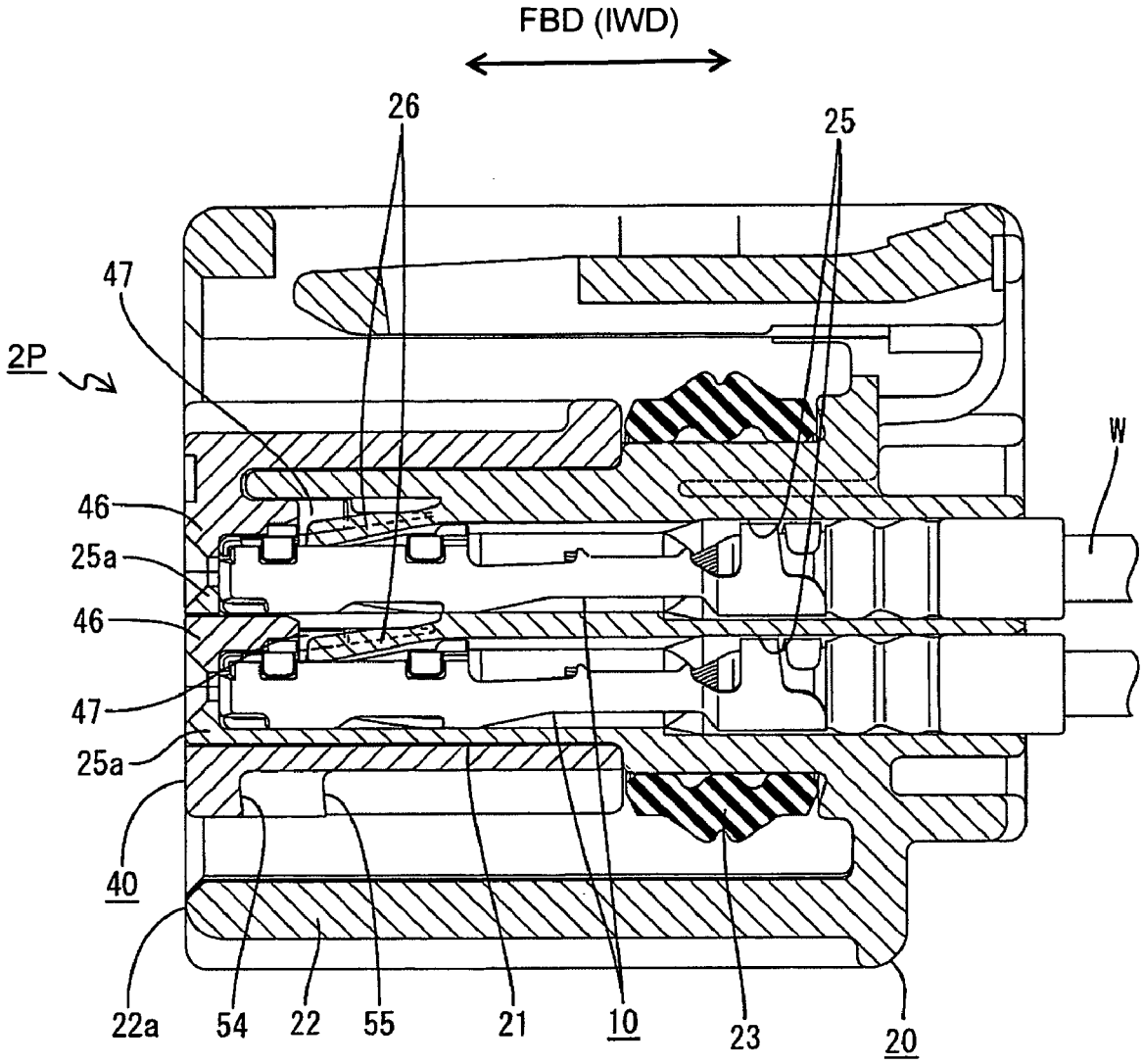
FIG. 13 is a section similar to FIG. 8, showing the mounting member at a full locking position.
Figure 14:
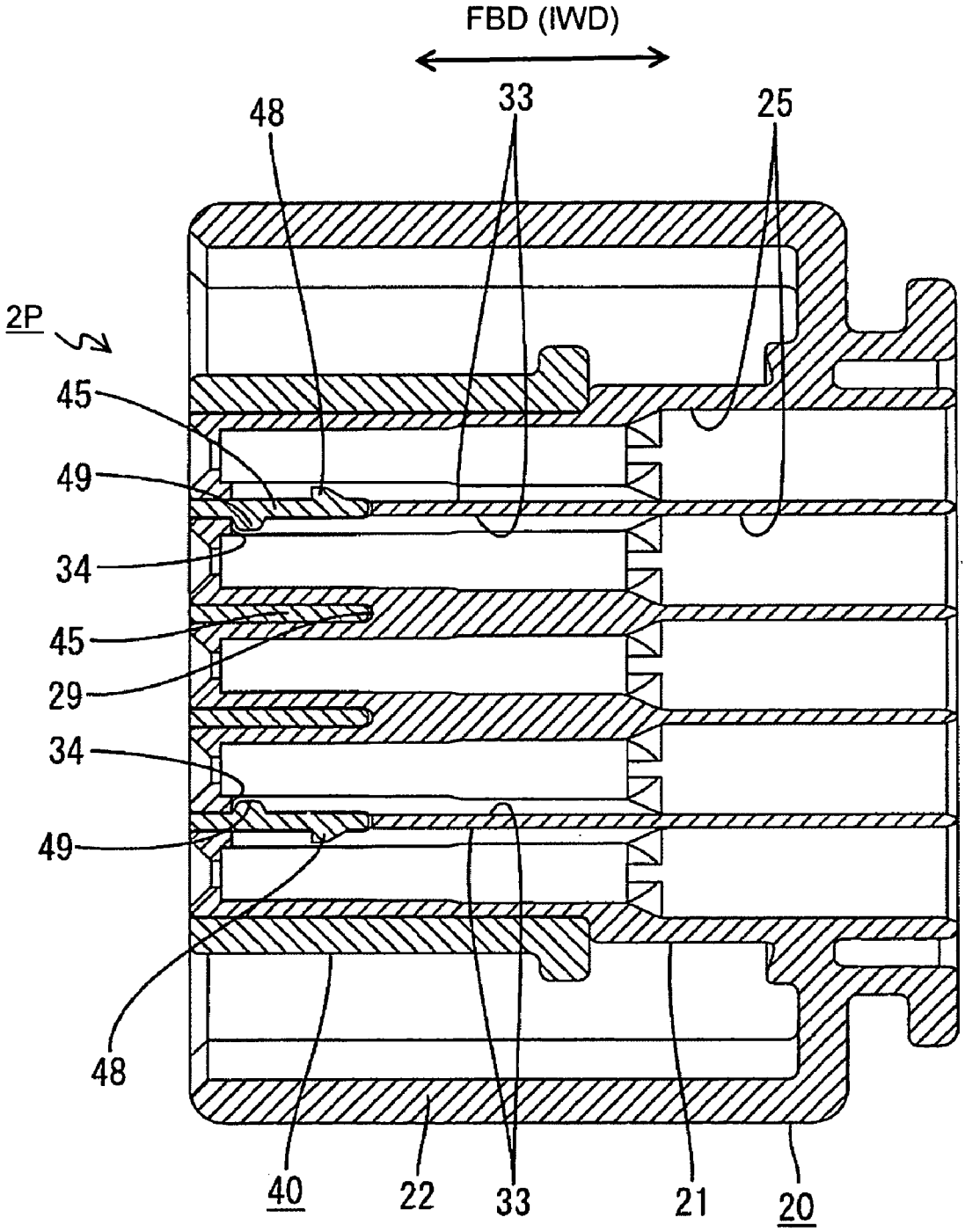
FIG. 14 is a section similar to FIG. 9, but showing the mounting member at the full locking position.
Figure 15:
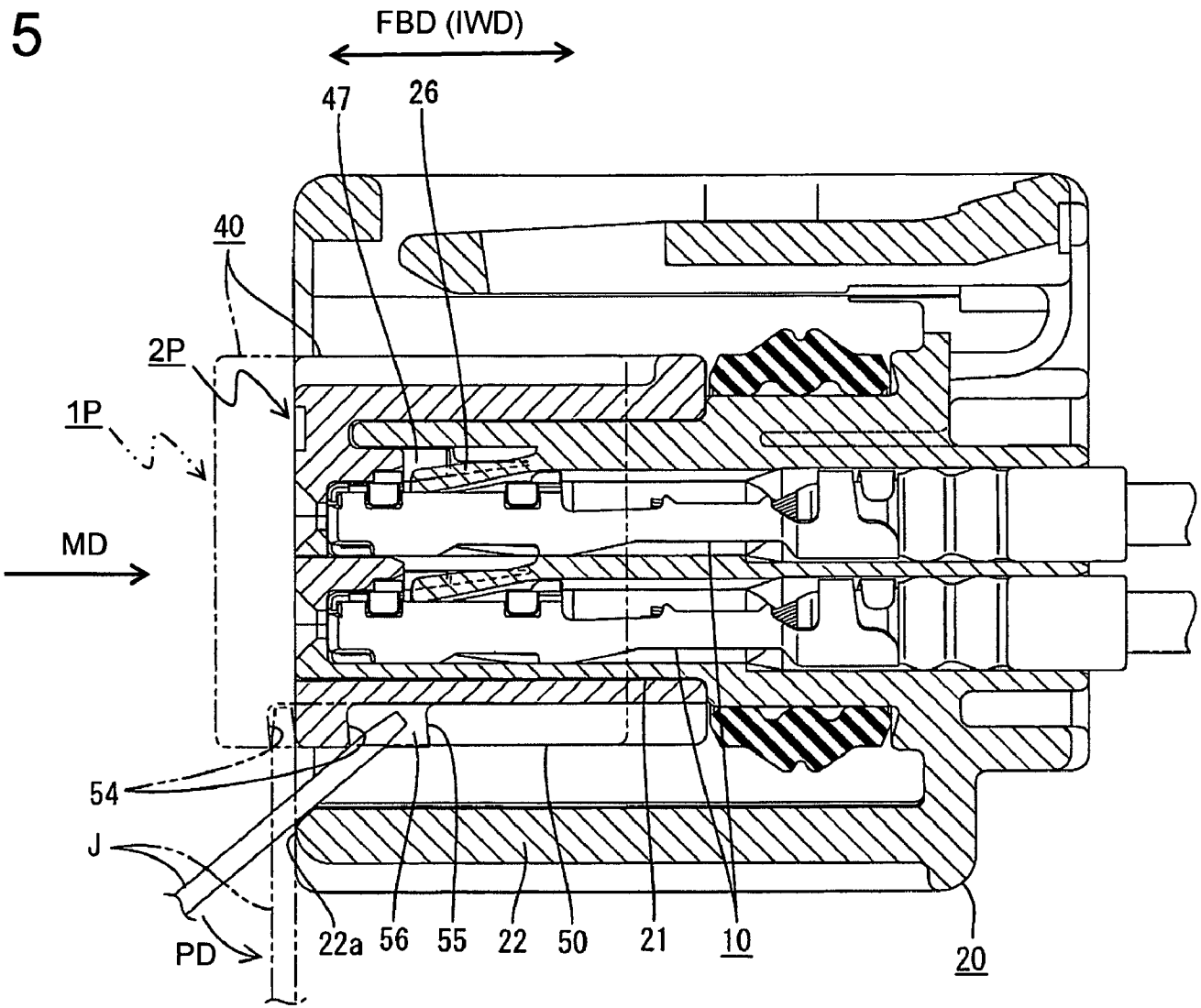
FIG. 15 is a section similar to FIG. 8, but showing an operation of moving the mounting member from the full locking position to the partial locking position by a jig.

The first holding projections 48 are in the locking grooves 33 when the mounting member 40 is at the partial locking position 1P. More particularly, the front surfaces of the first holding projections 48 engage the locking surfaces 34 at the front ends of the locking grooves 33 and the rear surfaces of the second holding projections 48 engage the front end surfaces of the front walls 25*b* of the cavities 25, as shown in FIG. 11, to hold the mounting member 40 at the partial locking position 1P. On the other hand, the second holding projections 49 are in the locking grooves 33 when the mounting member 40 is at the full locking position 2P. More particularly, the front surfaces of the second holding projections 49 engage the locking surfaces 34, the rear surface of the main portion 41 abuts against a step on the outer surface of the terminal accommodating portion 21, as shown in FIG. 14, and the guiding wall 31 contacts the edge of the guiding groove 44, as shown in FIG. 13, to hold the mounting member 40 at the full locking position 2P. The rear end surface of the step 42 engages the front surface of the seal ring 23 at the full locking position 2P and the front surfaces of the mounting member 40 and the housing 20 are substantially flush with each other.

Figure 7:
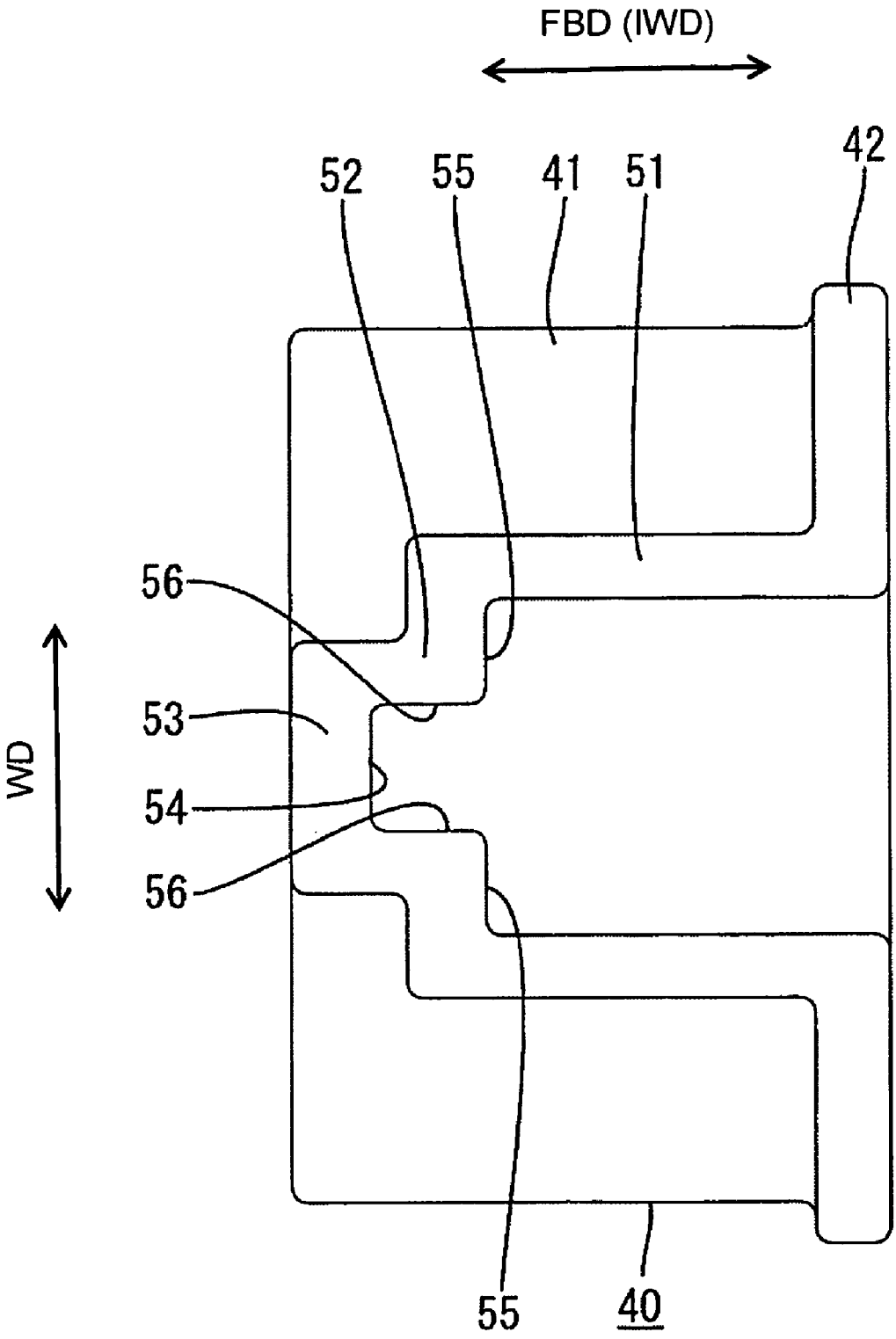
FIG. 7 is a bottom view of the mounting member.

As shown in FIGS. 7 and 8, a bulge 50 projects down and out from the bottom surface of the main portion 41, which is the outer peripheral surface of the mounting member 40. More specifically, the bulge 50 is transversely symmetrical, as shown in FIG. 7, and has two ribs 51 extending substantially along forward and backward directions FBD. Rear ends of the ribs 51 are coupled to the step 42. Two angled portions 52 extend specified distances towards each other substantially along width direction WD from the front ends of the respective ribs 51, and then extend specified distances forward. A coupling 53 couples the front ends of the two angled portions 52. A jig J is used to operate the mounting member 40 mounted in the housing 20 and can engage the rear end surfaces of the coupling 53 and/or either of the two angled portions 52 of the bulge 50. More particularly, a first jig catch 54 is defined at the rear end surface of the coupling 53 and second jig catches 55 are defined at the rear ends of the two angled portions 52.

The first and second jig catches 54, 55 are at different positions with respect to forward and backward directions FBD and the width direction WD. Specifically, the first jig catch 54 is more forward than the second jig catches 55 with respect to forward and backward directions FBD. The first jig catch 54 also is at an intermediate position of the mounting member 40 and the second jig catches 55 are at opposite sides of the first jig catch 54 with respect to the width direction WD. Inner side surfaces of the angled portions 52 define connections 56 that extend continuously between the first jig catch 54 and the second jig catches 55. A distance between the first jig catch 54 and the second jig catches 55 along the forward and backward direction FBD (or a moving direction MD of the mounting member 40) is substantially equal to a moving distance of the mounting member 40 between the partial locking position 1P and the full locking position 2P.

Figure 16:
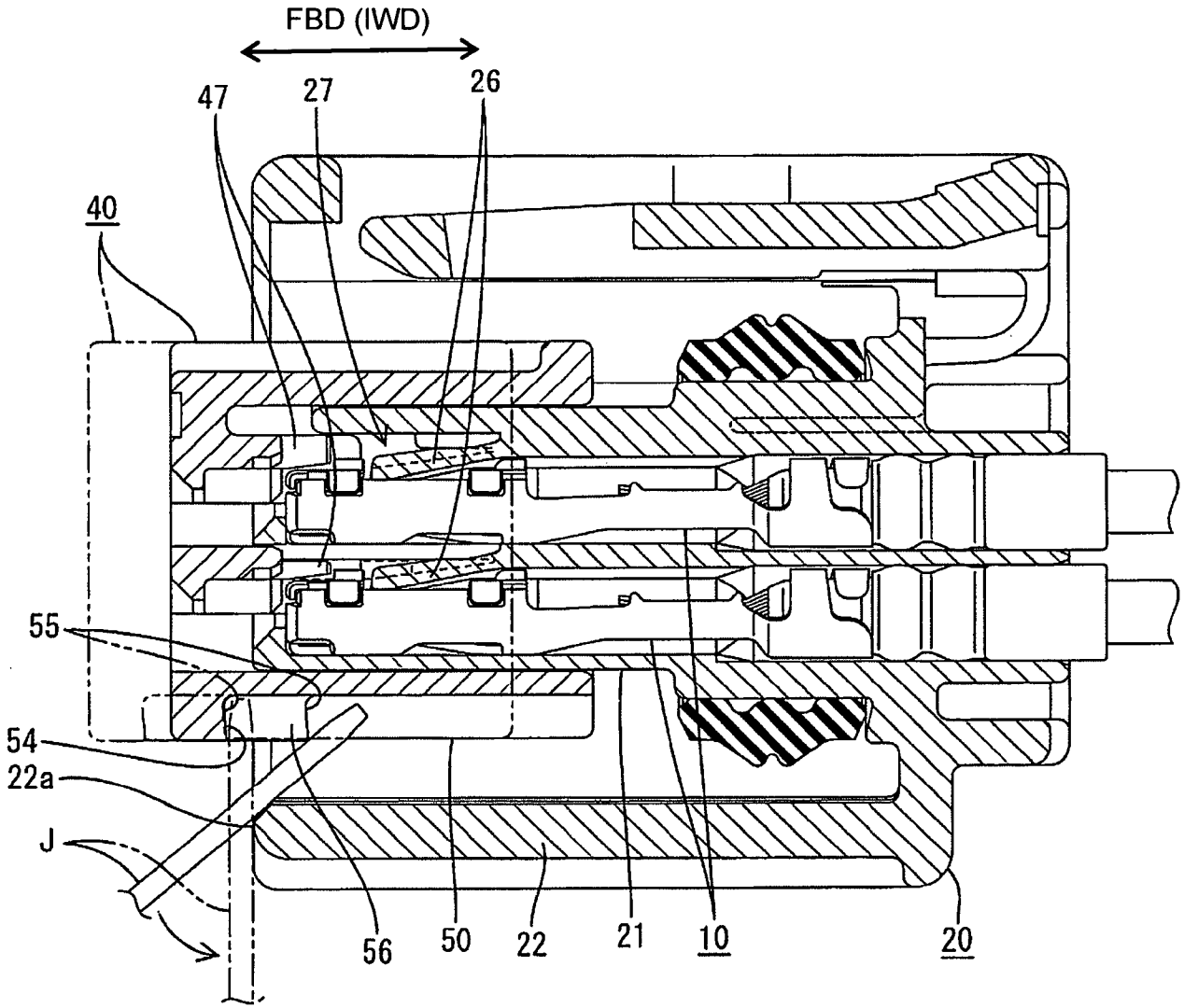
FIG. 16 is a section similar to FIG. 8, but showing an operation of detaching the mounting member from the partial locking position by the jig.

The leading end of the jig J can be inserted through the opening of the outer tube 22 and into engagement with one of the jig catches 54, 55. An intermediate portion of the jig J then is placed on the front-end 22*a* at the bottom part of the outer tube 22. The jig J then is levered with the intermediate portion as a fulcrum to move the mounting member 40 along the moving direction MD. The first jig catch 54 is caught by the jig J to move the mounting member 40 from the full locking position 2P to the partial locking position 1P. However, the second jig catch 55 is caught to move the mounting member 40 forward from the partial locking position 1P to detach the mounting member 40 from the housing 20. The first jig catch 54 is behind the front-end 22*a* of the outer tube 22, which is a fulcrum of the jig J, when the mounting member 40 is at the full locking position 2P shown in FIG. 15. On the other hand, with the mounting member 40 at the partial locking position 1P, the first jig catch 54 is before the front end 22*a* of the outer tube 22 by about the thickness of the jig J and the second jig catches 55 are behind the front end 22*a* of the outer tube 22 and substantially at the same position as the first jig catch 54 when the mounting member 40 is at the full locking position 2P as shown in FIG. 16.

Figure 12:
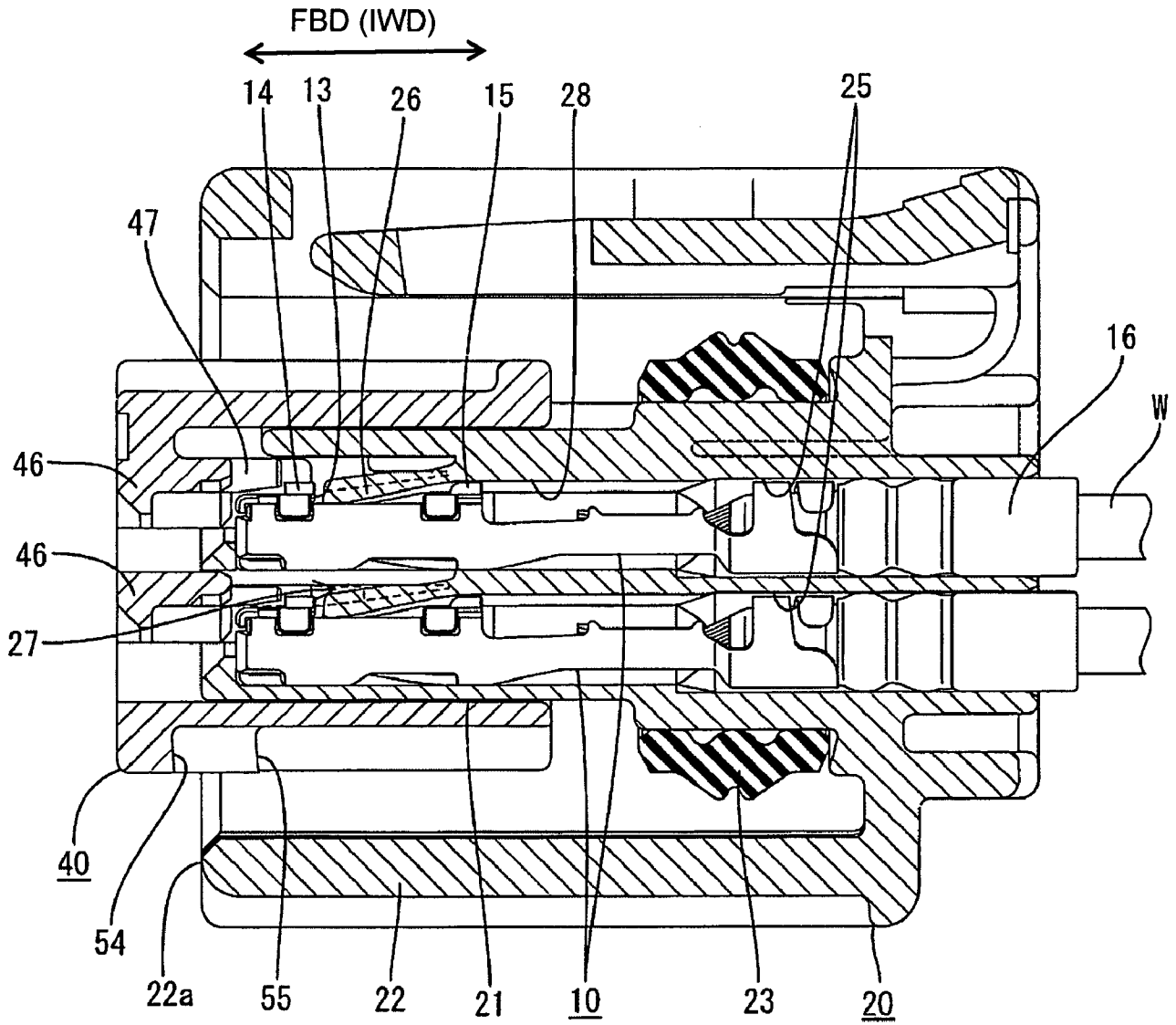
FIG. 12 is a section similar to FIG. 8, but showing terminal fittings inserted with the mounting member held at the partial locking position.

To assemble the female connector, the mounting member 40 is mounted at the partial locking position 1P in the housing 20 and the terminal fittings 10 connected with the ends of the wires W are inserted into the corresponding cavities 25 along the insertion and withdrawal direction IWD, as shown in FIGS. 10 and 11. Thus, the locking projection 14 and the protrusion 15 enter the insertion groove 28. The outer wall of the terminal fitting 10 and the locking projection 14 press the lock 26 when the terminal fitting 10 reaches a specified depth. Thus, the lock 26 temporarily deforms in a direction intersecting the insertion and withdrawal direction IWD. The lock 26 is restored resiliently when the terminal fitting 10 reaches a proper depth to engage the front edge of the notch 13 and the locking projection 14, as shown in FIG. 12. Thus, the terminal fitting 10 is retained primarily. At this time, the sealing plug 16 preferably is held in close contact with the inner peripheral surface of the cavity 25 to provide sealing in the cavity 25.

The mounting member 40 is moved in the moving direction MD from the partial locking position 1P to the full locking position 2P after the terminal fittings 10 have been inserted. Thus, the deformation preventing portions 47 enter the deformation spaces 27 for the corresponding locks 26, as shown in FIG. 13. As a result, the locks 26 cannot deform and the locking forces for the terminal fittings 10 are increased. At this time, the walls 46 fit into the cut parts of the surrounding walls of the cavities 25 so that the front ends of the terminal fittings 10 are supported over substantially their entire peripheries. Further, the partition walls 45 advance to the back ends of the corresponding grooves 29, as shown in FIG. 14, and insulate the terminal fittings 10 in the adjacent cavities 25 from each other. The assembled female connector then can be mated with the mating male connector.

The terminal fittings 10 may have to be detached from the housing 20 for maintenance or other reasons. In such a case, the female connector is separated from the male connector. The jig J then is inserted through the opening of the outer tube 22 to bring the leading end of the jig J into engagement with the first jig catch 54 of the mounting member 40. The intermediate portion of the jig J then is placed on the front-end 22*a* at the bottom of the outer tube 22 so that the jig J takes a forward-inclined posture with respect to the vertical direction. A gripped part of the jig J then is pushed back from the forward inclined posture to lever the jig J in a pivotal direction PD with the front-end 22*a* of the housing 20 as a fulcrum. Thus, the first jig catch 54 caught by the jig J is pushed forward substantially opposite to the moving direction MD to disengage the second holding projections 49 from the locking sections 34. As a result, the mounting member 40 is moved forward from the full locking position 2P (FIG. 14). The mounting member 40 reaches the partial locking position 1P when the jig J reaches a substantially vertical posture (substantially normal to the moving direction MD) as shown in phantom line in FIG. 15. Thus, the first lever operation is completed. In this process, the first jig catch 54 is the point of application of force and is close to the fulcrum at the front-end 22*a* of the outer tube 22. Accordingly, a smaller operation force is necessary, thereby improving operability.

The jig J is disengaged from the first jig catch 54 after the mounting member 40 reaches the partial locking position 1P. The leading end of the jig J then is held in sliding contact with the connecting portion 56 (see FIG. 7) to guide the jig J smoothly to the second jig catch 55, which is continuous with the connecting portion 56. It does not matter which of the left and right second jig catches 55 is caught by the jig J.

The jig J is moved to a forward-inclined posture again. The leading end of the jig J then is engaged with the second jig catch 55, as shown in FIG. 16 and the jig J is levered again. Thus, the jig J catches the second jig catch 55 and exerts a forward pushing force to disengage the first holding projections 48 from the locking sections 34. Thus, the mounting member 40 is moved forward from the partial locking position 1P (see FIG. 11). The lever operation is completed when the jig J reaches a substantially vertical posture (substantially normal to the moving direction MD), as shown in phantom line in FIG. 16. The second jig catch 55 is close to the fulcrum at the front-end 22*a* of the outer tube 22. Thus, a smaller operation force is necessary, thereby improving operability. The mounting member 40 then is held and detached from the housing 20. It should be noted that the position of the mounting member 40 after the completion of the lever operation may be displaced slightly forward or back from the phantom position of FIG. 16.

A jig can be used to deform the exposed lock 26 after the mounting member 40 is detached from the housing 20, thereby freeing the terminal fitting 10 from the locked state. The terminal fitting 10 then can be withdrawn from the housing 20 e.g. by pulling the wire W backward.

Figure 17:
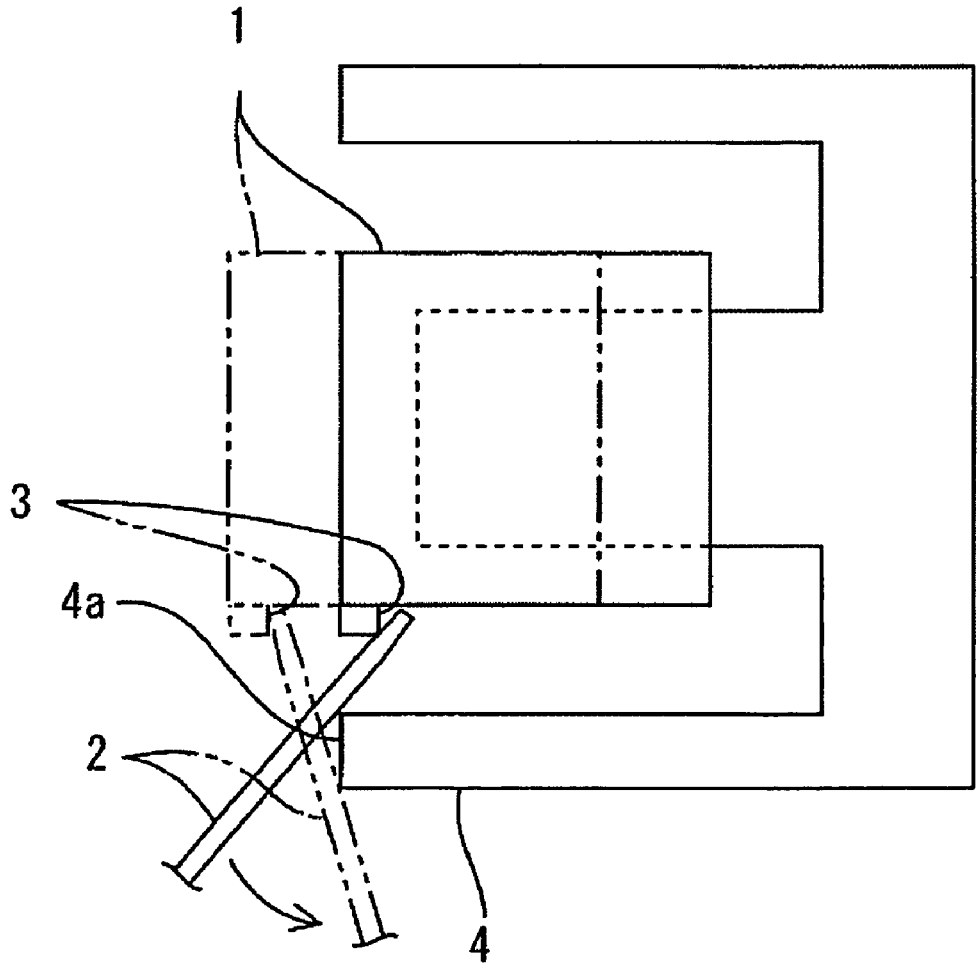
FIG. 17 PRIOR ART
FIG. 17 is a schematic view of a prior art connector.

As described above, the mounting member 40 has at least two jig catches 54, 55 displaced along forward and backward directions FBD (i.e. substantially along the moving direction MD of the mounting member 40). Thus, the jig J engages the first jig catch 54 to move the mounting member 40 forward by a specified distance. The jig J then engages the second jig catch 55 so that the lever operation is carried out stepwise. Therefore, it is sufficient to lever the jig J from the forward-inclined posture towards the substantially vertical posture (i.e. a posture having an orientation normal to the moving direction MD) to detach the mounting member 40 and it is not necessary to lever the jig J from the vertical posture to the backward-inclined posture of the prior art (see FIG. 17). Hence, the operability of the jig J is better.

Further, the first and second jig catches 54, 55 are displaced with respect to width direction WD, which is substantially normal to the moving direction MD and the forward and backward directions FBD. Additionally, the jig catches 54, 55 are connected by the connections 56. Thus, it is sufficient to move the jig J along the connection 56 upon engaging the jig J again. Thus, the operability of the jig J is even better.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The bulge is on the outer surface of the mounting member and the jig catches are provided there in the foregoing embodiment. However, a recess may be formed in the outer surface of the mounting member and the jig catches may be provided therein. In short, it is sufficient to form a step on the outer surface of the mounting member and to use the step as the jig catch.

The jig catches are provided on the bottom of the mounting member in the foregoing embodiment. However, they may be provided on the upper surface or the opposite side surfaces of the mounting member or any lateral surface. Alternatively, the first and second jig catches may be provided on different outer surfaces of the mounting member. Further, the number, shape and positions of the jig catches can be changed. For example, three or more jig catches may be provided at positions displaced along forward and backward directions, and the lever operation may be carried out in more steps.

The mounting member includes the walls that serve as parts of the surrounding walls of the cavities in the foregoing embodiment. However, the invention is also applicable to a front retainer with deformation preventing portions for the locks without having the walls. Conversely, the invention is also applicable to a front holder with walls without having the deformation preventing portions for the locks.

Although the first and second jig catches are connected by the connecting portions in the foregoing embodiment, the connecting portions can be dispensed with.

The mounting member is detached from the housing in the foregoing embodiment. However, the invention is also applicable, for example, to a case where a front retainer is moved from a full locking position to a partial locking position without being detachable.

The means for holding the mounting member in the housing can be changed. For example, the mounting member may be provided with one holding portion and the housing may be provided with two locking sections spaced along forward and backward directions and engageable with the holding portion.

Although a watertight connector is illustrated in the embodiment, the invention is also applicable to non-watertight connectors.

A female connector accommodating female terminal fittings is illustrated in the foregoing embodiment. However, the invention is also applicable to male connectors accommodating male terminal fittings having tabs extending forward from main portions.

What is claimed is:

1. A connector, comprising:

a housing including a terminal accommodating portion for accommodating at least one terminal fitting, at least one resiliently deformable lock provided in the terminal accommodating portion for locking the terminal fitting; and a mounting member mountable on the terminal accommodating portion substantially along forward and backward directions and being movable substantially alone the forward and backward directions between a first position and a second position, at least one deformation preventing portion provided on the mounting member for preventing resilient deformation of the lock, the deformation preventing portion being retracted forward from deformation spaces for the lock when the mounting member is in the first position and being in the deformation space when the mounting member is in the second position, the mounting member including a plurality of jig catching portions arranged at positions displaced along forward and backward directions and catchable by a jig inserted into the housing, whereby the mounting member is movable forward by levering the jig.

2. The connector of claim 1, wherein the housing comprises an outer tube at least partly surrounding the terminal accommodating portion and having a substantially open front end, wherein the mounting member is mountable to the terminal accommodating portion through an opening of the outer tube.

3. The connector of claim 1, wherein the jig can be levered with a portion of the outer tube as a fulcrum.

4. The connector of claim 1, wherein the mounting member includes at least a first jig catching portion for moving the mounting member from the second position to the first position and at least a second jig catching portion for detaching the mounting member from the first position, the first and second jig catching portions being arranged along forward and backward directions.

5. The connector of claim 4, wherein a distance between the first and second jig catching portions along the forward and backward direction is substantially equal to a moving distance of the mounting member between the first and second positions.

6. A connector comprising:

a housing including a terminal accommodating portion for accommodating at least one terminal fitting;

a mounting member mountable on the terminal accommodating portion substantially along forward and backward directions, the mounting member including a plurality of jig catching portions arranged at positions displaced along forward and backward directions and catchable by a jig inserted into the housing, the jig catching portions being arranged at positions displaced along a direction substantially normal to forward and backward directions and being connected by at least one connecting portion whereby the mounting member is movable forward by levering the jig.

7. The connector of claim 6, wherein the mounting member is movable substantially along forward and backward directions between a first position and a second position.

8. The connector of claim 7, wherein at least one resiliently deformable lock is provided in the terminal accommodating portion for locking the terminal fitting and at least one deformation preventing portion is provided on the mounting member for preventing resilient deformation of the lock, the deformation preventing portions being retracted forward from deformation spaces for the locks when the mounting member is in the first position and being in the deformation spaces when the mounting member is in the second position.

9. The connector of claim 6, wherein the jig is guided to the second jig catching portion by the connecting portion.

* * * * *